US011062649B2

(12) United States Patent
Kim et al.

(10) Patent No.: US 11,062,649 B2
(45) Date of Patent: Jul. 13, 2021

(54) LUMINANCE COMPENSATION DEVICE AND ELECTROLUMINESCENCE DISPLAY USING THE SAME

(71) Applicant: LG DISPLAY CO., LTD., Seoul (KR)

(72) Inventors: Bonghwan Kim, Paju-si (KR); Daekyung Kim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/730,508

(22) Filed: Dec. 30, 2019

(65) Prior Publication Data

US 2020/0211457 A1 Jul. 2, 2020

(30) Foreign Application Priority Data

Dec. 31, 2018 (KR) ..... 10-2018-0173624

(51) Int. Cl.
*G09G 3/3225* (2016.01)
*G09G 3/3275* (2016.01)

(52) U.S. Cl.
CPC ..... *G09G 3/3225* (2013.01); *G09G 3/3275* (2013.01); *G09G 2310/0291* (2013.01); *G09G 2320/0626* (2013.01); *G09G 2320/0673* (2013.01)

(58) Field of Classification Search
CPC ..... G09G 3/3225; G09G 3/3275; G09G 2310/0291; G09G 2320/0626; G09G 2320/0673; G09G 2330/021; G09G 2330/028; G09G 2300/0814; G09G 2300/0819; G09G 2320/045; G09G 3/3233; G09G 3/3291
See application file for complete search history.

(56) References Cited

U.S. PATENT DOCUMENTS

2010/0277513 A1* 11/2010 Byun ..... G09G 3/3291 345/690
2013/0135272 A1* 5/2013 Park ..... G09G 3/3233 345/211
2013/0176349 A1* 7/2013 Park ..... G09G 3/3291 345/690
2013/0249881 A1* 9/2013 Chae ..... G09G 3/32 345/211
2014/0362124 A1* 12/2014 Kim ..... G09G 3/3233 345/690
2015/0170560 A1* 6/2015 Lim ..... G09G 3/3291 345/691

(Continued)

*Primary Examiner* — Ibrahim A Khan
(74) *Attorney, Agent, or Firm* — Birch, Stewart, Kolasch & Birch, LLP

(57) ABSTRACT

A luminance compensation device can include a luminance compensator configured to: receive a pixel driving voltage from a host system, the pixel driving voltage being supplied to both the luminance compensator and a display panel, receive a reference pixel driving voltage generated by a drive IC, compare the pixel driving voltage with the reference pixel driving voltage to detect a voltage drop in the pixel driving voltage, the voltage drop being a difference between the pixel driving voltage and the reference pixel driving voltage, amplify the voltage drop of the pixel driving voltage by a predetermined weighted value to generate an amplified voltage drop, and adjust a gamma reference voltage based on the amplified voltage drop to generate an adjusted gamma reference voltage.

18 Claims, 13 Drawing Sheets

(56) References Cited

U.S. PATENT DOCUMENTS

| | | | | |
|---|---|---|---|---|
| 2015/0262532 | A1* | 9/2015 | Lim | G09G 3/3291 345/690 |
| 2016/0049113 | A1* | 2/2016 | Park | G09G 3/3266 345/212 |
| 2016/0055799 | A1* | 2/2016 | Eom | G09G 3/3225 345/690 |
| 2016/0118022 | A1* | 4/2016 | Chun | G09G 3/2007 345/690 |
| 2017/0032742 | A1* | 2/2017 | Piper | G09G 3/3233 |
| 2019/0340980 | A1* | 11/2019 | Yum | G09G 3/3233 |
| 2020/0111423 | A1* | 4/2020 | Orio | G09G 3/3291 |
| 2020/0112654 | A1* | 4/2020 | Saito | H04N 5/202 |
| 2020/0143750 | A1* | 5/2020 | Gao | G09G 3/3291 |
| 2020/0279519 | A1* | 9/2020 | Oho | G09G 3/006 |

* cited by examiner

IMG1 IMG2 IMG3

LUMINANCE COMPENSATION DEVICE AND ELECTROLUMINESCENCE DISPLAY USING THE SAME

This application claims the priority benefit of Korean Patent Application No. 10-2018-0173624 filed in the Republic of Korea on Dec. 31, 2018, the entirety of which is incorporated herein by reference for all purposes as if fully set forth herein.

BACKGROUND OF THE INVENTION

Field of the Invention

The present disclosure relates to a luminance compensation device that compensates for the luminance of pixels by varying gamma reference voltage based on a voltage drop in a display panel, and an electroluminescent display using the same.

Related Art

Electroluminescence displays are roughly classified into inorganic light-emitting displays and organic light-emitting displays depending on the material of an emission layer. Of these, an active-matrix organic light emitting display includes organic light-emitting diodes (hereinafter, "OLED"), which emit light by themselves, and has the advantages of fast response time, high luminous efficiency, high brightness, and wide viewing angle. Since the organic light-emitting display can display black levels as solid black, it can produce images with much greater contrast ratios and higher color reproduction.

An OLED, which is used as a light emitting element of an organic light-emitting display, includes an anode, a cathode, and an organic compound layer situated between these electrodes. The organic compound layer includes a hole injection layer (HIL), a hole transport layer (HTL), an emission layer (EML), an electron transport layer (ETL), and an electron injection layer (EIL). When a voltage is applied to the anode and cathode, a hole passing through the hole transport layer HTL and an electron passing through the electron transport layer ETL move to the emission layer EML, forming an exciton. As a result, the emission layer EML generates visible light.

SUMMARY OF THE INVENTION

A pixel driving voltage ELVDD is applied to pixels to drive the pixels. A voltage drop occurs to the pixel driving voltage ELVDD depending on the load in the display panel. The number of pixels (hereinafter, "ON pixels") that emit light may vary with each input image within the screen of the display panel. The intensity of current (I) flowing through the display panel may vary with the proportion of ON pixels. As the proportion of ON pixels varies, the current also varies, causing a variation of the pixel driving voltage ELVDD. This is because the current (I) in an IR drop varies with the proportion of ON pixels. Due to this, the luminance of the pixels varies with the proportion of ON pixels within the screen.

In view of this, the inventors of the present disclosure performed various tests to compensate for luminance depending on the proportion of ON pixels. Through these tests, they invented a luminance compensation device capable of compensating for luminance depending on the proportion of ON pixels and also compensating for luminance by reflecting an IR drop inside the display panel, and an electroluminescence display using the same.

An example embodiment of the present disclosure provides a luminance compensation device including a luminance compensator that compares a pixel driving voltage input from a host system and a reference pixel driving voltage generated within a drive IC to detect a voltage drop in the pixel driving voltage, and that amplifies the voltage drop by a predetermined weighted value to adjust a gamma reference voltage by the amplified voltage drop. The pixel driving voltage is supplied to a display panel. The luminance compensator amplifies a difference between the pixel driving voltage and the reference pixel driving voltage.

Another example embodiment of the present disclosure provides an electroluminescence display including a display panel where a plurality of data lines, a plurality of gate lines, and a plurality of pixels to be supplied with a pixel driving voltage are arranged; a gamma compensated voltage generator configured to divide a gamma reference voltage to produce gamma compensated voltages; a data driver configured to convert a pixel data to the gamma compensated voltages to output data voltages and supply the data voltage to the data lines; and a luminance compensator configured to compare a pixel driving voltage input from a host system and a reference pixel driving voltage to detect a voltage drop in the pixel driving voltage, and amplify the voltage drop by a predetermined weighted value to adjust the gamma reference voltage by the amplified voltage drop.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DESCRIPTION OF THE EMBODIMENTS

Figure 1:
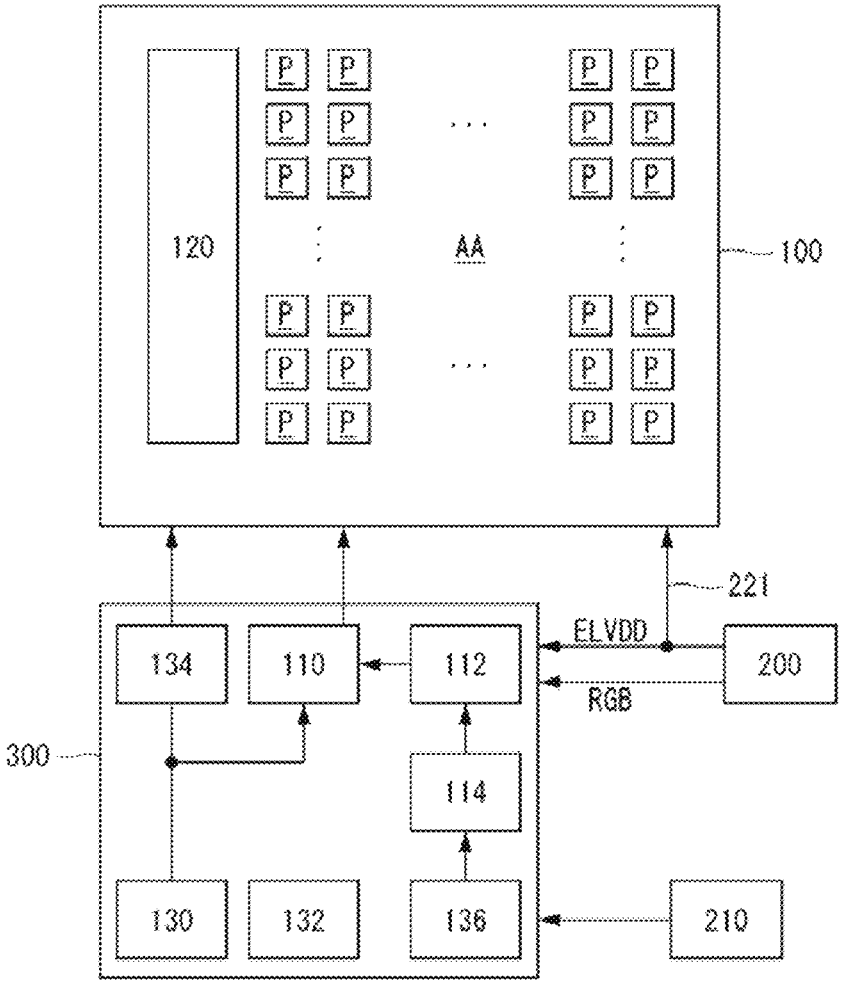
FIG. 1 is a block diagram showing an electroluminescence display according to an embodiment of the present disclosure.

Various aspects and features of the present disclosure and methods of accomplishing them may be understood more readily by reference to the following detailed descriptions of example embodiments and the accompanying drawings. The present disclosure may, however, be embodied in many different forms and should not be construed as being limited to the embodiments set forth herein. Rather, these example embodiments are provided so that this disclosure will be thorough and complete and will fully convey the concept of the present disclosure to those skilled in the art, and the present disclosure is defined by the appended claims.

The shapes, sizes, proportions, angles, numbers, etc. shown in the figures to describe the embodiments of the present disclosure are merely examples and not limited to those shown in the figures. Like reference numerals denote like elements throughout the specification. In describing the present disclosure, detailed descriptions of related well-known technologies will be omitted to avoid unnecessary obscuring the present disclosure. When the terms "comprise," "have," "consist of" and the like are used, other parts may be added as long as the term "only" is not used. The singular forms may be interpreted as the plural forms unless explicitly stated.

The elements may be interpreted to include an error margin even if not explicitly stated.

When the position relation between two parts is described using the terms "on," "over," "under," "next to" and the like, one or more parts may be positioned between the two parts as long as the term "immediately" or "directly" is not used.

It will be understood that, although the terms first, second, etc., may be used to describe various elements, these elements should not be limited by these terms. These terms are only used to distinguish one element from another element. Thus, a first element discussed below could be termed a second element without departing from the technical concept of the present disclosure.

Like reference numerals denote like elements throughout the specification.

The features of various embodiments of the present disclosure may be coupled or combined with one another either partly or wholly, and may technically interact or work together in various ways. The embodiments may be carried out independently or in association with one another.

In an electroluminescence display of the present disclosure, a pixel circuit can include either an n-channel transistor or a p-channel transistor or both. The transistors can be implemented as an oxide thin-film transistor (TFT) including an oxide semiconductor or an LTPS TFT including low-temperature polysilicon (LTPS). Each transistor can be implemented as a p-channel TFT or an n-channel TFT. An embodiment will be described with respect to an example in which the transistors of a pixel circuit are implemented as p-channel TFTs, but the present disclosure is not limited thereto.

The transistor is a three-electrode device with gate, source, and drain. The source is an electrode that provides carriers to the transistor. The carriers in the transistor flow from the source. The drain is an electrode where the carriers leave the TFT. That is, the carriers in the transistor flow from the source to the drain. In the situation of the n-channel transistor, the carriers are electrons, and thus the source voltage is lower than the drain voltage so that the electrons flow from the source to the drain. In the n-channel transistor, current flows from the drain to the source. In the situation of the p-channel transistor, the carriers are holes, and thus the source voltage is higher than the drain voltage so that the holes flow from the source to the drain. In the p-channel transistor, since the holes flow from the source to the drain, current flows from the source to the drain. It should be noted that the source and drain of the transistor are not fixed in position. For instance, the source and drain are interchangeable depending on the applied voltage. Therefore, the present disclosure is not limited by the source and drain of the transistor. In the following description, the source and drain of the transistor will be referred to as first and second electrodes.

A gate signal swings between gate-on voltage and gate-off voltage. The gate-on voltage is set higher than the threshold voltage of the transistor, and the gate-off voltage is set lower than the threshold voltage of the transistor. The transistor turns on in response to the gate-on voltage and turns off in response to the gate-off voltage. In the n-channel transistor, the gate-on voltage can be gate-high voltage VGH, and the gate-off voltage can be gate-low voltage VGL. In the p-channel transistor, the gate-on voltage can be gate-low voltage VGL, and the gate-off voltage can be gate-high voltage VGH.

Hereinafter, various embodiment of the present disclosure will be described in detail with reference to the accompanying drawings. In the embodiments below, an electroluminescence display will be described with respect to an organic light-emitting display including an organic light-emitting material, but is not limited to it.

Referring to FIG. 1, an electroluminescence display according to the present disclosure includes a display panel 100 and a drive IC (integrated circuit) 300 for writing an input image's pixel data RGB to pixels on the display panel 100. The display panel 100 can include a gate driver 120. The driver IC 300 is connected to a host system 200 and a first memory 210.

Figure 4A:
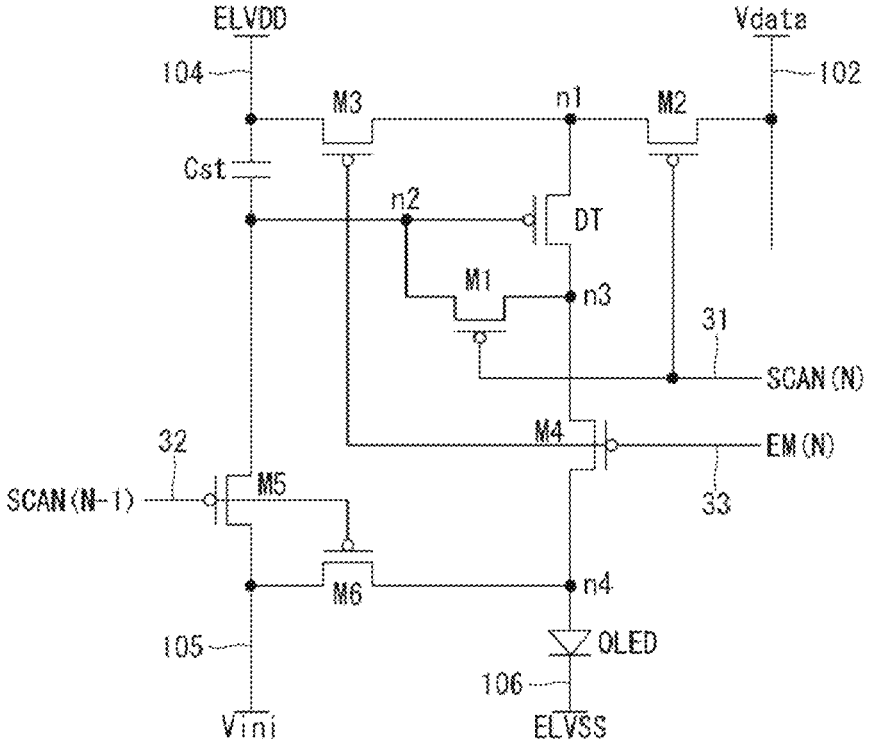
FIG. 4A is a circuit diagram showing an example of a pixel circuit according to an embodiment of the present disclosure.
Figure 4B:
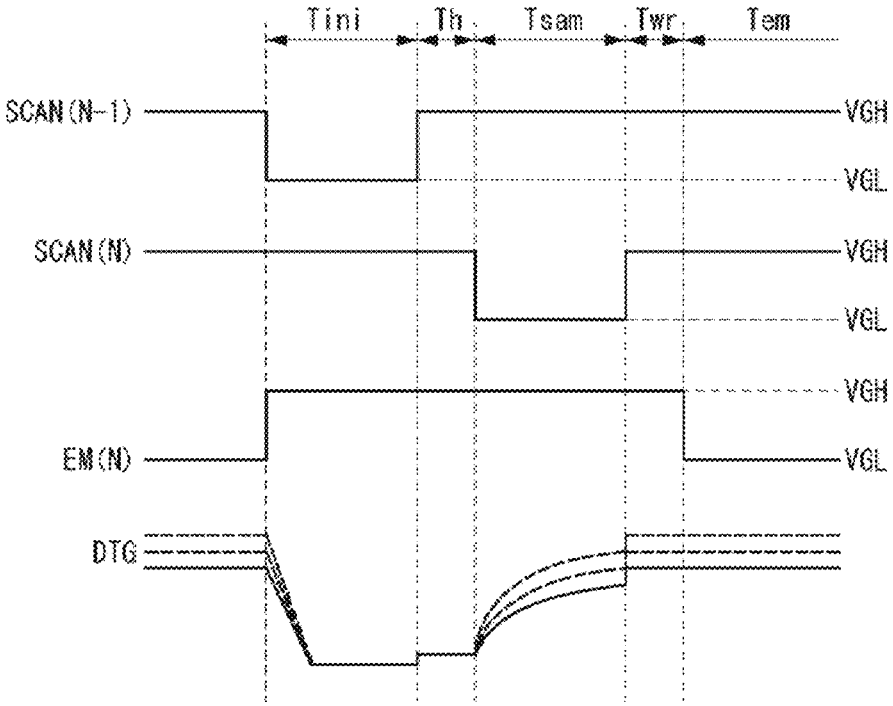
FIG. 4B is a view showing a method of driving the pixel circuit shown in FIG. 4A according to an embodiment of the present disclosure.

A screen AA on the display panel 100 where an input image is reproduced includes data lines DL1 to DL6, gate lines GL1 and GL2 intersecting the data lines DL1 to DL6, and a pixel array of pixels P arranged in a matrix. The data lines DL1 to DL6 supply data signals DATA1 to DATA6 output from the drive IC 300 to the pixels P. The gate lines GL1 and GL2 supply gate signals GATE1 and GATE2 from the gate driver 120 to the pixels P. As shown in FIGS. 4A and 4B, the gate signals GATE1 and GATE2 include scan signals [SCAN(N−1) and SCAN(N)] and an emission control signal (hereinafter, "EM signal") [EM(N)].

Each pixel includes sub-pixels of different colors for color representation. The sub-pixels include a red sub-pixel (hereinafter, "R sub-pixel"), a green sub-pixel (hereinafter, "G sub-pixel"), and a blue sub-pixel (hereinafter, "B sub-pixel"). However, the sub-pixels are not limited to the above, but can further include a white sub-pixel (hereinafter, "W sub-pixel"). Each sub-pixel can be implemented as a pixel circuit including an internal compensation circuit.

Figure 2:
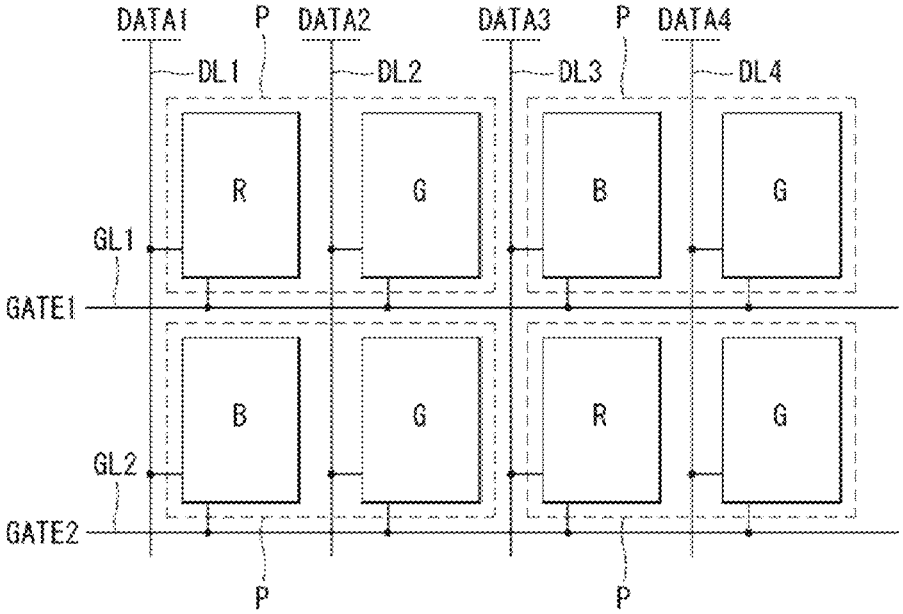
FIG. 2 is a view showing an example of a pentile pixel layout according to an embodiment of the present disclosure.
Figure 3:
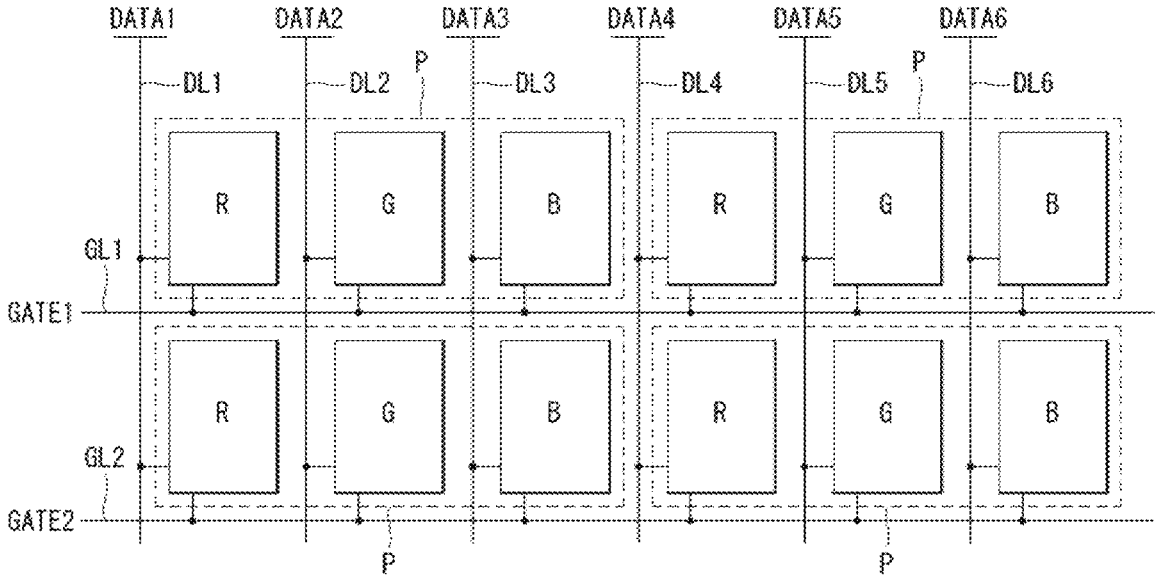
FIG. 3 is a view showing an example of a real pixel layout according to an embodiment of the present disclosure.

The pixels are arranged in a real pixel layout or a pentile pixel layout. In the pentile pixel layout, two sub-pixels of different colors are driven as one pixel by using a preset pentile pixel rendering algorithm, as shown in FIG. 2. The pentile pixel rendering algorithm compensates for lack of color representation in each pixel by the color of light emitted from a neighboring pixel. In the real pixel layout, one pixel P consists of R, G, and B sub-pixels as shown in FIG. 3.

As shown in FIG. 4A, the display panel 100 includes an VDD line 104 for supplying a pixel driving voltage ELVDD to the pixels P, a *Vini* line 105 for supplying a reset voltage *Vini* to the pixels P, and a VSS electrode 106 for supplying a low-potential power supply voltage ELVSS to the pixels P.

In a mobile device, the display panel 100 can be implemented as a plastic electroluminescence panel. The plastic electroluminescence panel includes a pixel array on an organic thin film bonded onto a back plate. A touch sensor array can be formed on the pixel array. The back plate can be a PET (polyethylene terephthalate) substrate, but not limited to it. The back plate prevents moisture intrusion to keep the pixel array from exposure to moisture, and supports the organic thin film where the pixel array is formed. The organic thin film can be a thin PI (polyimide) film substrate, but not limited to it. Multiple layers of buffer film of insulating material can be formed on the organic thin film. Wires connected to the pixel array and touch sensor array can be formed on the organic thin film.

Referring to FIG. 1, the drive IC 300 includes a data driver 110, a gamma compensated voltage generator 112, a luminance compensator 114, a timing controller 130, a power supply part 136, a second memory 132, and a level shifter 134. The drive IC 300 is connected to the host system 200, first memory 210, and display panel 100.

The data driver 110 converts an input image's digital video data, for example, pixel data RGB, received from the timing controller 130 to gamma compensated voltages through a digital-to-analog converter (hereinafter, "DAC") to produce data signals DATA1 to DATA6. The DAC converts pixel data RGB to gamma compensated voltages to produce voltages of data signals DATA1 to DATA6. In FIG. 4, Vdata can be voltages of data signals DATA1 to DATA6, for example, data voltages. The data voltages Vdata can be set to 3 V to 6 V, but not limited thereto. The data driver 110 supplies the data signals DATA1 to DATA6 to the pixels P through the data lines DL1 to DL6.

The gamma compensated voltage generator 112 receives a high-potential gamma reference voltage VH and a low-potential gamma reference voltage VL from the luminance compensator 114, and divides the high-potential gamma reference voltage VH through a voltage dividing circuit to produce gamma compensated voltages for each gray level between the high-potential gamma reference voltage VH and the low-potential gamma reference voltage VL.

A gamma reference voltage from the luminance compensator 114 is divided through a voltage dividing circuit to thereby produce gamma compensated voltages for each gray level and supply them to the data driver 110.

The gate driver 120, along with the pixel array, can be mounted on a substrate of the display panel 100. The gate driver 120 can be implemented as a GIP (gate-in-panel) circuit which is formed directly on the display panel 100. The gate driver 120 outputs gate signals GATE1 and GATE2 to the gate lines GL1 and GL2 under control of the timing controller 130. The gate lines GL1 and GL2 each can include a first gate line 31 to which an Nth scan signal [SCAN(N)] (N is a positive integer equal to or greater than 2) is applied, a second gate line 32 to which an (N−1)th scan signal [SCAN(N−1)] is applied, and a third gate line 33 to which an EM signal [EM(N)] is applied.

The gate driver 120 can sequentially supply the gate signals GATE1 and GATE2 to the gate lines 104 by shifting the gate signals GATE1 and GATE2 using a shift register. The scan signals [SCAN(N−1)] and [SCAN(N)] are synchronized with the data signals DATA1 to DATA6. The gate signals GATE1 and GATE2 swing between the gate-on voltage VGL and the gate-off voltage VGH. The gate-on voltage VGL and the gate-off voltage VGH can be set to 8 V and −7 V, respectively, but not limited thereto.

The timing controller 130 supplies an input image's pixel data RGB received from the host system 200 to the data driver 110. The timing controller 130 controls the operation timings of the gate driver 120 and data driver 110 by timing control signals which are generated using a timing signal received from the host system 200.

The level shifter 134 converts the low-level voltage of a gate timing control signal received from the timing controller 130 to gate-on voltage VGL and the high-level voltage of the gate timing control signal to gate-off voltage VGH, and supplies them to the gate driver 120.

The second memory 132 is an internal memory of the drive IC 300. The second memory 132 stores compensation values, register setting data, etc. which are received from the first memory 210 when power is applied. The compensation values can be applied to various algorithms for improving picture quality. The register setting data defines the operations of the data driver 110, timing controller 130, and gamma compensated voltage generator 112. The first memory 210 can include a flash memory. The second memory 132 can include an SRAM (static RAM).

The power supply part 136 generates electrical power used to drive the pixel array of the display panel 100 and the drive IC 300 by using a DC-to-DC converter. The DC-to-DC converter includes a charge pump, a regulator, a buck converter, a boost converter, etc. The power supply part 136 can generate direct current voltages, such as gate-on voltage VGL, gate-off voltage VGH, reference pixel driving voltage INT_ELVDD, reference voltages VCI* and VCI', low-potential power supply voltage ELVSS, and reset voltage Vini, by regulating a direct current input voltage Vin from the host system 200.

The reference pixel driving voltage INT_ELVDD and the reference voltages VCI* and VCI' are supplied to the luminance compensator 114. Gate voltages such as the gate-on voltage VGL and the gate-off voltage VGH are supplied to the level shifter 134 and the gate driver 120.

Pixel voltages, such as the low-potential power supply voltage ELVSS, the reset voltage Vini, and the pixel driving voltage ELVDD from the host system 200 are supplied commonly to the pixels P. The pixel voltages can be set to INT_ELVDD=4.6 V, ELVSS=−2 to −3 V, and Vini=−3 to −4 V, but not limited thereto.

The host system 200 can include an application processor (AP) in the situation of a mobile device, a wearable device, or a virtual reality/augmented reality device. The host system 200 can be a mainboard for a television system, set-top box, navigation system, personal computer PC, or home theater system, but is not limited thereto.

The pixel driving voltage ELVDD from the host system 200 is supplied to the VDD line 104 of the pixel array through a flexible printed circuit (FPC). The pixel driving voltage ELVDD is 4.6 V when generated, which is the same voltage level as the reference pixel driving voltage INT_ELVDD, but the voltage drop ΔV may vary with load fluctuations on the display panel 100 which vary with the proportion of ON pixels on the display panel 100. The pixel driving voltage ELVDD becomes to ELVDD=4.6 V−ΔV.

The luminance compensator 114 can reduce differences in luminance between different proportions of ON pixels by detecting a voltage drop ΔV in the pixel driving voltage ELVDD, amplifying the voltage drop ΔV, and adjusting the high-potential and low-potential gamma reference voltages VH and VL by the amplified voltage drop ΔV.

FIG. 4A is a circuit diagram showing an example of a pixel circuit. The pixel circuit of the present disclosure is not limited what is shown in FIG. 4A. FIG. 4B is a view showing a method of driving the pixel circuit shown in FIG. 4A.

Referring to FIGS. 4A and 4B, the pixel circuit includes a light-emitting diode OLED, a driving element DT that supplies a current to the light-emitting diode OLED, and an internal compensation circuit that samples the threshold voltage Vth of the driving element DT using a plurality of switching elements M1 to M6 and compensates for the gate voltage of the driving element DT by the threshold voltage Vth of the driving element DT. The driving element DT and the switching elements M1 to M6 can be implemented as p-channel transistors, but not limited thereto.

The operation of the internal compensation circuit is divided into a reset period Tini during which the fifth and sixth switching elements M5 and M6 are turned on by the gate-on voltage VGL of the (N−1)th scan signal [SCAN (N−1)] to reset the pixel circuit, a sampling period Tsam during which the first and second switching elements M1 and M2 are turned on by the gate-on voltage VGL of the Nth scan signal [SCAN(N)] to sample the threshold voltage of the driving element DT and store it in a capacitor Cst, a data writing period Twr during which the first to sixth switching elements M1 to M6 maintain the off state, and an emission period Tem during which the third and fourth switching elements M3 and M4 are turned on to allow the light-emitting diode OLED to emit light.

In the emission period Tem, the EM signal [EM(N)] swings between the gate-on voltage VGL and the gate-off voltage VGH at a predetermined duty cycle so that the third and fourth switching elements M3 and M4 can go on and off repeatedly, in order to precisely represent a low grayscale luminance.

The light-emitting diode OLED can be implemented as an OLED, but not limited thereto. The light-emitting diode OLED includes an anode, a cathode, and an organic compound layer situated between these electrodes. The organic compound layer can include, but is not limited to, a hole injection layer HIL, a hole transport layer HTL, an emission layer EML, an electron transport layer ETL, and an electron injection layer EIL. The anode of the light-emitting diode OLED is connected to a fourth node n4 between the fourth and sixth switching elements M4 and M6. The fourth node n4 is connected to the anode of the light-emitting diode OLED, a second electrode of the fourth switching element M4, and a second electrode of the sixth switching element M6. The cathode of the light-emitting diode OLED is connected to the VSS electrode 106 to which a low-potential power supply voltage VSS is applied. The light-emitting diode OLED emits light by a current Ids flowing in response to the gate-source voltage Vgs of the driving element DT. A current path of the light-emitting diode OLED is switched by the third and fourth switching elements M3 and M4.

A storage capacitor Cst is connected between the VDD line 104 and a second node n2. The data voltage Vdata compensated by the threshold voltage Vth of the driving element DT is stored in the storage capacitor Cst. Since the data voltage Vdata for each sub-pixel is compensated for by the threshold voltage Vth of the driving element DT, variations in the characteristic of the driving element DT between each pixel can be compensated for.

The first switching element M1 is turned on in response to the gate-on voltage VGL of the Nth scan signal [SCAN (N)] to connect a second node n2 and a third node n3. The second node n2 is connected to a gate of the driving element DT, a first electrode of the storage capacitor Cst, and a first electrode of the first switching element M1. The third node n3 is connected to a second electrode of the driving element DT, a second electrode of the first switching element M1, and a first electrode of the fourth switching element M4. A gate of the first switching element M1 is connected to the first gate line 31 and receives the Nth scan signal [SCAN (N)]. The first electrode of the first switching element M1 is connected to the second node n2, and the second electrode of the first switching element M1 is connected to the third node n3.

The second switching element M2 is turned on in response to the gate-on voltage VGL of the Nth scan signal [SCAN(N)] to supply a data voltage Vdata to the first node n1. A gate of the second switching element M2 is connected to the first gate line 31 and receives the Nth scan signal [SCAN(N)]. A first electrode of the second switching element M2 is connected to the first node n1. A second electrode of the second switching element M2 is connected to a data line DL to which the data voltage Vdata is applied. The first node n1 is connected to the first electrode of the second switching element M2, a second electrode of the third switching element M3, and a first electrode of the driving element DT.

The third switching element M3 is turned on in response to the gate-on voltage VGL of the EM signal [EM(N)] to connect the VDD line 104 to the first node n1. A gate of the third switching element M3 is connected to the third gate line 33 and receives the EM signal [EM(N)]. A first electrode of the third switching element M3 is connected to the VDD line 104. The second electrode of the third switching element M3 is connected to the first node n1.

The fourth switching element M4 is turned on in response to the gate-on voltage VGL of the EM signal [EM(N)] to connect the third node n3 to the anode of the light-emitting diode OLED. A gate of the fourth switching element M4 is connected to the third gate line 33 and receives the EM signal [EM(N)]. The first electrode of the fourth switching element M4 is connected to the third node n3, and the second electrode thereof is connected to the fourth node n4.

The EM signal [EM(N)] switches the current path of the light-emitting diode OLED by controlling the on/off state of the third and fourth switching elements M3 and M4, so that the on and off times of the light-emitting diode OLED are controlled.

The fifth switching element M5 is turned on in response to the gate-on voltage VGL of the (N−1)th scan signal [SCAN(N−1)] to connect the second node n2 to the Vini line 105. A gate of the fifth switching element M5 is connected to the second gate line 32 and receives the (N−1)th scan signal [SCAN(N−1)]. A first electrode of the fifth switching element M5 is connected to the second node n2, and a second electrode thereof is connected to the Vini line 105.

The sixth switching element M6 is turned on in response to the gate-on voltage VGL of the (N−1)th scan signal

[SCAN(N−1)] to connect the Vini line 105 to the fourth node n4. A gate of the switch switching element M6 is connected to the second gate line 32 and receives the (N−1)th scan signal [SCAN(N−1)]. A first electrode of the sixth switching element M6 is connected to the Vini line 105, and the second electrode thereof is connected to the fourth node n4.

The driving element DT drives the light-emitting diode OLED by adjusting the current Ids flowing through the light-emitting diode OLED in response to the gate-source voltage Vgs. The driving element DT includes a gate connected to the second node n2, a first electrode connected to the first node n1, and a second electrode connected to the third node n3.

The (N−1)th scan signal [SCAN(N−1)] is generated as the gate-on voltage VGL during the reset period Tini. The Nth scan signal [SCAN(N)] and the EM signal [EM(N)] maintain the gate-off voltage VGH during the reset period Tini. Thus, the fifth and sixth switching elements M5 and M6 are turned on during the reset period Tini to reset the second and fourth nodes n2 and n4 to Vini. A hold period Th can be set between the reset period Tini and the sampling period Tsam. The gate signals [SCAN(N−1), SCAN(N), and EM(N)] hold the previous state during the hold period Th.

The Nth scan signal [SCAN(N)] is generated as the gate-on voltage VGL during the sampling period Tsam. A pulse of the Nth scan signal [SCAN(N)] is synchronized with the data voltage Vdata of the Nth pixel line. The (N−1)th scan signal [SCAN(N−1)] and the EM signal [EM(N)] maintain the gate-off voltage VGH during the sampling period Tsam. Thus, the first and second switching elements M1 and M2 are turned on during the sampling period Tsam.

The gate voltage DTG of the driving element DT rises due to the current flowing through the first and second switching elements M1 and M2 during the sampling period Tsam. When the driving element DT is turned off, the gate node voltage DTG equals Vdata−|Vth|. In this situation, the voltage of the first node n1 also equals Vdata−|Vth|. During the sampling period Tsam, the gate-source voltage Vgs of the driving element DT is |Vgs|=Vdata−(Vdata−|Vth|)=|Vth|.

The Nth scan signal [SCAN(N)] is inverted to the gate-off voltage VGH during the data writing period Twr. The (N−1)th scan signal [SCAN(N−1)] and the EM signal [EM(N)] maintain the gate-off voltage VGH during the data writing period Twr. Thus, all the switching elements M1 to M6 maintain the off state during the data writing period Twr.

During the emission period Tem, the EM signal [EM(N)] swings between the gate-on voltage VGL and the gate-off voltage VGH as it goes on and off at a predetermined duty cycle. The (N−1)th and Nth scan signals [SCAN(N−1) and SCAN(N)] maintain the gate-off voltage VGH during the emission period Tem. The third and fourth switching elements M3 and M4 go on and off repeatedly in response to the voltage of the EM signal EM during the emission period Tem. When the EM signal [EM(N)] is the gate-on voltage VGL, the third and fourth switching elements M3 and M4 are turned on so that a current flows through the light-emitting diode OLED. In this situation, Vgs of the driving element DT is |Vgs|=VDD−(Vdata−|Vth|), and the current flowing through the light-emitting diode OLED is $K(VDD-Vdata)^2$. K is a proportional constant determined by the charge mobility, parasitic capacitance, channel capacity, etc. of the driving element DT.

Figure 5:
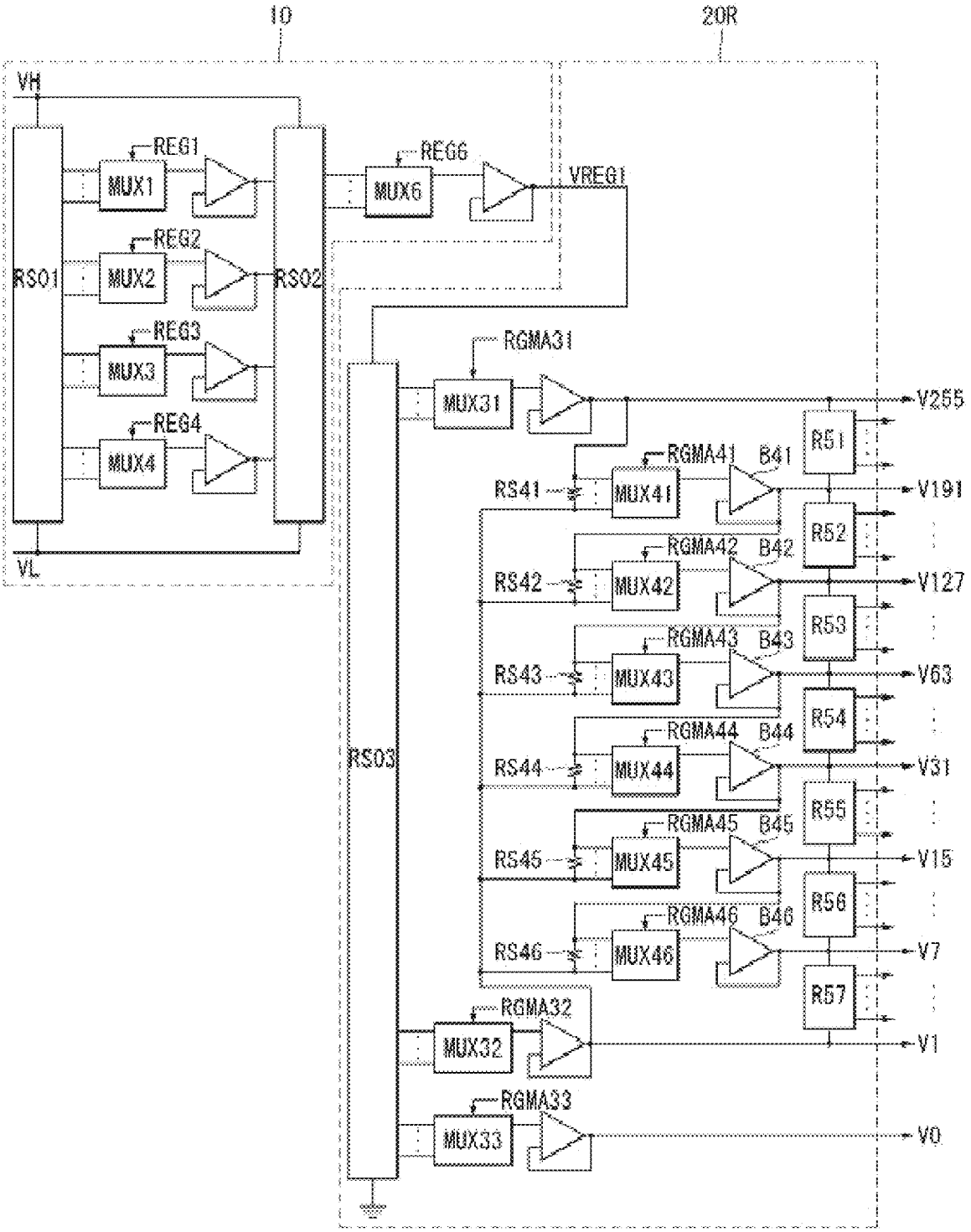
FIG. 5 is a circuit diagram showing an example of a gamma compensated voltage generator according to an embodiment of the present disclosure.

FIG. 5 is a circuit diagram showing an example of a gamma compensated voltage generator.

Referring to FIG. 5, the gamma compensated voltage generator 112 includes a first voltage dividing circuit RS01, a first voltage selector, a second voltage dividing circuit RS02, a second voltage selector, a third voltage dividing circuit RS03, a third voltage selector, fourth voltage dividing circuits RS41 to RS46, a fourth voltage selector, and fifth voltage dividing circuits R51 to R57.

The first voltage dividing circuit RS01 divides the high-potential gamma reference voltage VH using resistors connected in series between the high-potential gamma reference voltage VH and the low-potential gamma reference voltage VL to output voltages of different voltage levels.

The first voltage selector selects a voltage output from the first voltage dividing circuit RS01. The first voltage selector includes (1-1)th to (1-4)th multiplexers MUX1 to MUX4 that are connected between the first voltage dividing circuit RS01 and the second voltage dividing circuit RS02 and supply the voltage selected by the first voltage dividing circuit RS01 to the second voltage dividing circuit RS02. The (1-1)th to (1-4)th multiplexers MUX1 to MUX4 output voltages that are lower than the high-potential gamma reference voltage VH and have different voltage levels, and supply them to nodes of the second voltage dividing circuit RS02. The voltages output from the (1-1)th to (1-4)th multiplexers MUX1 to MUX4 are applied through buffers directly to the nodes of the second voltage dividing circuit RS02 which are spaced out at regular intervals. The (1-1)th to (1-4)th multiplexers MUX1 to MUX4 can adjust set voltages according to register settings REG1 to REG4.

The register settings REG1 to REG4, REG6, RGAMA31 to RGAMA33, and RGAMA41 to RGAMA46 can be stored in the first memory 210 before product shipment and then transmitted to the second memory 132 when the electroluminescence display is powered on, or can be stored in the second memory 132 before product shipment. The register settings REG1 to REG4 are register setting values used for optical compensation or for adjusting luminance in connection with DBV (Display Brightness Value). The DBV may vary with an illumination sensor output signal from the host system 200 or a luminance input value from the user.

The second voltage dividing circuit RS02 includes resistors connected in series between a node to which the high-potential gamma reference voltage VH is applied and a node to which the low-potential gamma reference voltage VL is applied. The second voltage dividing circuit RS02 divides the high-potential gamma reference voltage VH to output voltages of different voltage levels through the nodes between the resistors.

The second voltage selector includes a multiplexer MUX6 which selects a first reference voltage VREG1 by selecting one of the nodes in the second voltage dividing circuit RS02 according to the register setting REG6. The output voltage of the multiplexer MUX6 may vary with the register setting REG6. The first reference voltage VREG1 output from the multiplexer MUX6 is supplied to the third voltage dividing circuit RS03 through a buffer.

The third voltage dividing circuit RS03 divides the first reference voltage VREG1 using resistors connected in series between the first reference voltage VREG1 and the ground voltage GND to output voltages of different voltage levels.

The third voltage selector includes a (3-1)th multiplexer MUX31 which selects one of high-potential nodes in the third voltage dividing circuit RS03 according to the register setting RGMA31 to output a high-potential gamma reference voltage from the selected node as the highest gamma compensated voltage V255, a (3-2)th multiplexer MUX32 which selects one from a first group of low-potential nodes in the third voltage dividing circuit RS03 according to the register setting RGMA32 to output a low-potential voltage from the selected node as a seventh gamma tap voltage V1, and a (3-3)th multiplexer MUX33 which selects one from a second group of low-potential nodes in the third voltage dividing circuit RS03 according to the register setting RGMA33 to output the lowest gamma compensated voltage V0 from the selected node.

The fourth voltage dividing circuits RS41 to RS46 include (4-1)th to (4-6)th voltage dividing circuits RS41 to RS46 which divide the voltages between the highest gamma compensated voltage V255 and the seventh gamma tap voltage V1 to output gamma compensated voltages for each gray level.

The fourth voltage selector includes (4-1)th to (4-6)th voltage selectors which output first to sixth gamma tap voltages V191, V127, . . . , V7 using multiplexers MUX41 to MUX49. The first to sixth gamma tap voltages V191, V127, . . . , V7 are lower than the highest gamma compensated voltage V255 and higher than the lowest gamma tap voltage V1.

The (4-1)th voltage dividing circuit RS41 divides the highest gamma compensated voltage V255 using resistors connected in series between the highest gamma compensated voltage V255 and the seventh gamma tap voltage V1. The (4-1)th voltage selector includes a (4-1)th multiplexer MUX41 which selects one of nodes in the (4-1)th voltage dividing circuit R41. The (4-1)th multiplexer MUX41 selects one of nodes in the (4-1)th voltage dividing circuit R41 to output a voltage from the selected node. The output voltage of the (4-1)th multiplexer MUX41 is output as the first gamma tap voltage V191 through a buffer B41. The first gamma tap voltage V191 is a gamma compensated voltage corresponding to the grayscale value 191 of pixel data RGB.

The (4-2)th voltage dividing circuit RS42 divides the first gamma tap voltage V191 using resistors connected in series between the first gamma tap voltage V191 and the seventh gamma tap voltage V1. The (4-2)th multiplexer MUX42 selects one of nodes in the (4-2)th voltage dividing circuit R42 according to the register setting RGMA42 to output a voltage from the selected node. The output voltage of the (4-2)th multiplexer MUX42 is output as the second gamma tap voltage V127 through a buffer B42. The second gamma tap voltage V127 is a gamma compensated voltage corresponding to the grayscale value 127 of the pixel data RGB.

The (4-6)th voltage dividing circuit RS46 divides the fifth gamma tap voltage V15 using resistors connected in series between the fifth gamma tap voltage V15 and the seventh gamma tap voltage V1. The (4-6)th multiplexer MUX46 selects one of nodes in the (4-6)th voltage dividing circuit R46 according to the register setting RGMA46 to output a voltage from the selected node. The output voltage of the (4-6)th multiplexer MUX46 is output as the sixth gamma tap voltage V7 through a buffer B46. The sixth gamma tap voltage V7 is a gamma compensated voltage corresponding to the grayscale value 7 of the pixel data RGB.

The fifth voltage dividing circuits R51 to R57 divide the highest gamma compensated voltage V255 using resistors connected in series between the highest gamma compensated voltage V255 and the seventh gamma tap voltage V1 to output gamma compensated voltages V1 to V255 of different voltage levels for different gray levels. The (5-1)th voltage dividing circuit R51 outputs gamma compensated voltages for different gray levels between the highest gamma compensated voltage V255 and the first gamma tap voltage V191 using resistors connected in series between the highest gamma compensated voltage V255 and the first gamma tap voltage V191. The (5-2)th voltage dividing circuit R52 outputs gamma compensated voltages for different gray levels between the first gamma tap voltage V191 and the second gamma tap voltage V127 using resistors connected in series between the first gamma tap voltage V191 and the second gamma tap voltage V127. The (5-6)th voltage dividing circuit R56 outputs gamma compensated voltages for different gray levels between the fifth gamma tap voltage V15 and the sixth gamma tap voltage V7 using resistors connected in series between the fifth gamma tap voltage V15 and the sixth gamma tap voltage V7. The (5-7)th voltage dividing circuit R57 outputs gamma compensated voltages for different gray levels between the sixth gamma tap voltage V7 and the seventh gamma tap voltage V1 using resistors connected in series between the sixth gamma tap voltage V7 and the seventh gamma tap voltage V1. The gamma compensated voltages V0 to V255 are supplied to the DAC of the data driver 110.

Gamma compensated voltages for data voltages can be implemented as positive gamma compensated voltages or negative gamma compensated voltages, depending on the pixel circuit's structure. For example, in a situation where the transistors for driving the light-emitting diodes, for example, OLEDs, of pixels are implemented as n-channel MOSFETs, and data voltages are applied to the gates of the transistors, positive gamma compensated voltages are generated. Thus, the higher the grayscale value of pixel data RGB, the higher the gamma compensated voltage. FIG. 5 is an example view of the gamma compensated voltage generator 112 that generates positive gamma compensated voltages. In a situation where the transistors for driving the light-emitting diodes, for example, OLEDs, of pixels are implemented as p-channel MOSFETs, and data voltages are applied to the gates of the transistors, negative gamma compensated voltages are generated. Thus, the higher the grayscale value of pixel data RGB, the lower the gamma compensated voltage. In this situation, the voltage levels of VH and VL in FIG. 5 are reversed, and the voltage levels of VREG1 and VREG2 are reversed too.

Figure 6:
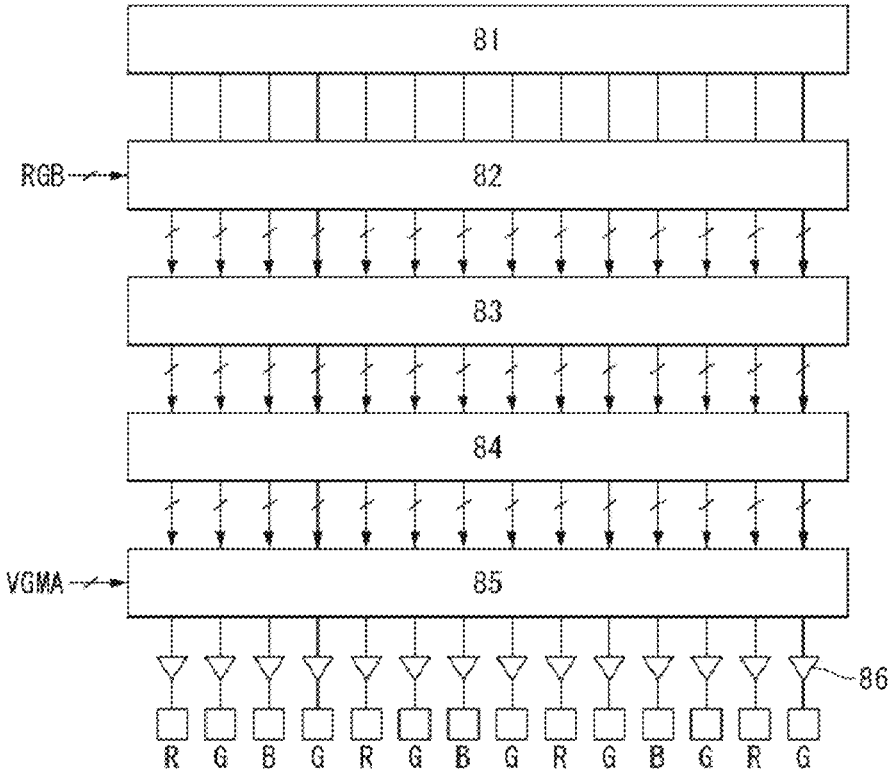
FIG. 6 is a block diagram showing an example of a data driver according to an embodiment of the present disclosure.

FIG. 6 is a block diagram showing an example of a data driver.

Referring to FIG. 6, the data driver 110 includes a shift register 81, a first latch 82, a second latch 83, a level shifter 84, a DAC 85, and buffers 86.

The shift register 81 shifts clocks input from the timing controller 130 and sequentially outputs sampling clocks. The first latch 82 samples and latches an input image's pixel data RGB at sampling clock timings sequentially input from the shift register 81, and simultaneously outputs the sampled pixel data RGB. The second latch 83 simultaneously outputs the pixel data RGB input from the first latch 82.

The level shifter 84 shifts the voltage of the pixel data RGB input from the second latch 83 within the input voltage range of the DAC 85. The DAC 85 converts the pixel data RGB from the level shifter 84 to the gamma compensated voltages from the gamma compensated voltage generator 112 to output data voltages. The data voltages output from the DAC 85 are supplied to the data lines DL1 to DL6 through the buffers 86.

Figure 7:
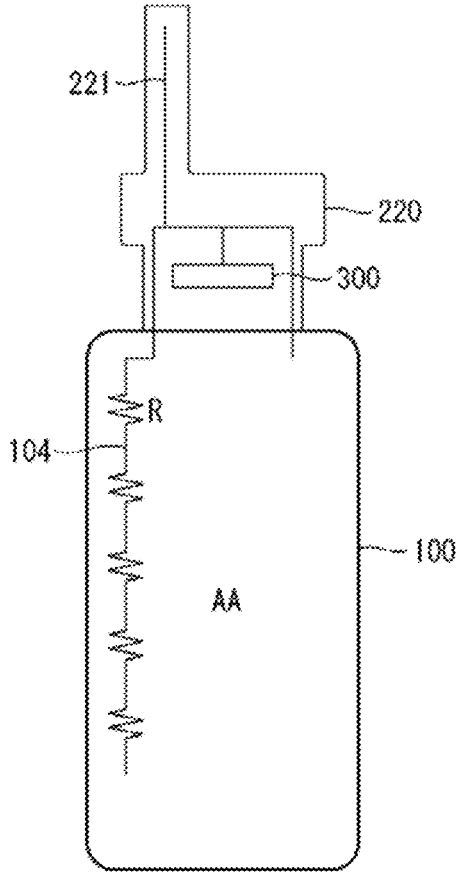
FIG. 7 is a view showing a path of a pixel driving voltage supplied from a host system to a display panel according to an embodiment of the present disclosure.

FIG. 7 is a view showing a path of a pixel driving voltage supplied from a host system to a display panel.

Referring to FIG. 7, the host system 200 is connected to the drive IC 300 and the display panel 100 through a flexible circuit board, for example, FPC 220.

The host system 200 can send an input image's pixel data RGB to the drive IC 300 through an MIPI (mobile industry processor interface). A pixel driving voltage ELVDD generated from the host system 200 is supplied to the drive IC 300 and the display panel 100 through a power wire 221 formed on the FPC 220. The power wire 221 on the FPC 220 is connected to the VDD line 104 on the display panel 100.

The pixel driving voltage ELVDD drops due to an IR drop due to the load on the display panel 100, and the amount LV of voltage drop varies with load fluctuations on the display panel 100. The load on the display panel 100 is affected by physically fixed values, such as resistance R and capacitance C, and varying values, such as the proportion of ON pixels.

Figure 8A:
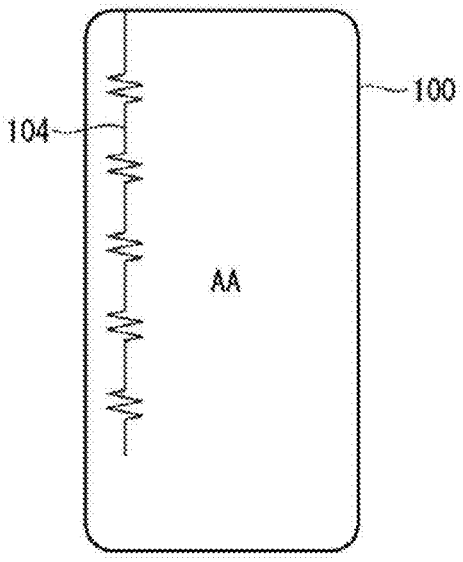
FIGS. 8A and 8B are views showing the amount of current varying with the proportion of ON pixels on a screen according to an embodiment of the present disclosure.
Figure 8B:
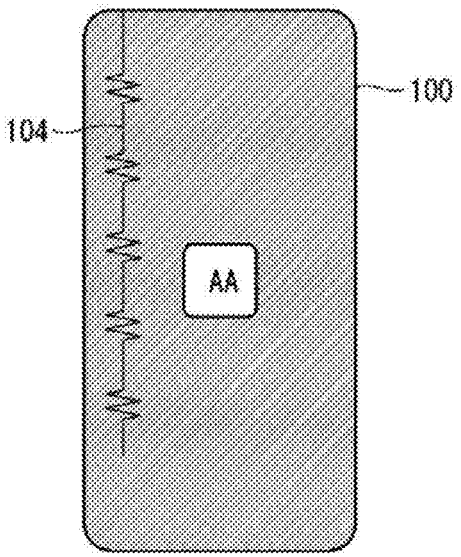

FIG. 8A shows an example in which all pixels in a screen AA emit light at a white level. FIG. 8A shows an example image with a high proportion of ON pixels. FIG. 8B shows an example in which most of the screen AA is a black level except for a white-level small box at the center in the screen AA. FIG. 8B shows an example image of a low proportion of ON pixels.

The proportion of ON pixels varies with the distribution of gray levels in an image. For example, an image with a high average picture level (hereinafter, "APL") has a high proportion of ON pixels because the screen has a high brightness overall, as shown in FIG. 8A. If the proportion of ON pixels is high, the amount of current on the display panel 100 is large, which increases the voltage drop ΔV in the pixel driving voltage ELVDD by that much. As opposed to this, an image with a low APL has a low proportion of ON pixels on the screen, as shown in FIG. 8B. If the proportion of ON pixels is low, the amount of current on the display panel 100 is small, which decreases the voltage drop ΔV in the pixel driving voltage ELVDD by that much. Due to this, an image with a low proportion of ON pixels can have better luminance at the same gray level.

The luminance compensator 114 minimizes luminance differences resulting from load fluctuations on the display panel 100 by adjusting the data voltages applied to the pixels P based on the actual voltage drop ΔV in the pixel driving voltage ELVDD generated on the screen AA of the display panel 100. To this end, the luminance compensator 114 adjusts the data voltages Vdata depending on the load fluctuations on the display panel 100 by detecting a voltage drop Δ V in the pixel driving voltage ELVDD, amplifying the voltage drop to reflect the actual voltage drop on the display panel 100, and adjusting the gamma compensated voltages.

Figure 9:
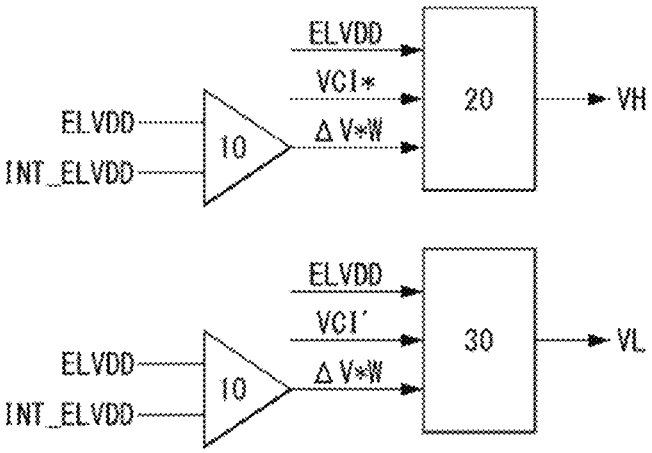
FIG. 9 is a block diagram showing a luminance compensator according to an embodiment of the present disclosure.
Figure 10:
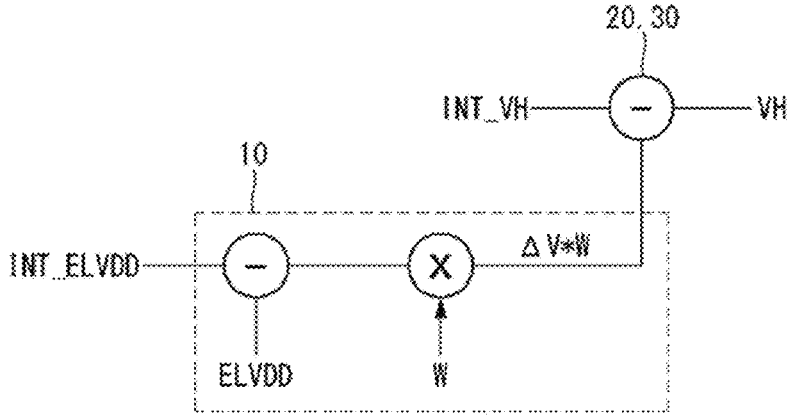
FIG. 10 is a view showing the operation of the luminance compensator according to an embodiment of the present disclosure.

FIGS. 9 and 10 are block diagrams showing a luminance compensator according to an embodiment of the present disclosure.

Referring to FIGS. 9 and 10, the luminance compensator 114 includes a voltage drop amplifier 10 and first and second gamma reference voltage regulators 20 and 30.

The voltage drop amplifier 10 detects a voltage drop ΔV in the pixel driving voltage ELVDD by comparing the pixel driving voltage ELVDD with a reference pixel driving voltage INT_ELVDD, and amplifies the voltage drop ΔV by a predetermined weighted value W. Although the pixel driving voltage ELVDD and the reference pixel driving voltage INT_ELVDD are generated at the same voltage level, the pixel driving voltage ELVDD varies with load fluctuations on the display panel 100 but the reference pixel driving voltage INT_ELVDD is separated from the display panel 100 and therefore fixed regardless of the load on the display panel 100. In other words, the voltage level of INT_ELVDD can remain set at a constant level, because INT_ELVDD (which is fixed) is independent from the pixel driving voltage ELVDD (which varies). Although the voltage difference between the pixel driving voltage ELVDD and the reference pixel driving voltage INT_ELVDD can be detected as a voltage drop ΔV in the pixel driving voltage ELVDD, there may still be a difference between this voltage drop and the actual voltage drop experienced in the display panel 100. This is because the drive IC 300 compares the pixel driving voltage ELVDD and the reference pixel driving voltage INT_ELVDD before the pixel driving voltage ELVDD is applied to the display panel 100.

The pixel driving voltage ELVDD varies with load fluctuations on the display panel 100, but the amount of variation is smaller than the actual voltage drop because the pixel driving voltage ELVDD is applied to the drive IC 300 before it is applied to the display panel 100. In embodiments of the present disclosure, the voltage drop in the pixel driving voltage ELVDD is amplified before it is applied to the display panel 100 by multiplying the difference between the pixel driving voltage ELVDD applied to the drive IC 300 and the reference pixel driving voltage INT_ELVDD generated within the drive IC 300 by a weighted value W, in order to reflect the actual voltage drop in the pixel driving voltage ELVDD on the display panel 100.

The weighted value W can be adjusted by the amplification ratio of an operational amplifier (OP AMP). The weighted value W is determined based on an actual measurement of a variation in the pixel driving voltage ELVDD on the display panel 100. The weighted value W can be set to 1, 1.33, 1.66, and 2, but not limited thereto. The voltage drop ΔV in the pixel driving voltage ELVDD is amplified by an amount equal to ΔV*W.

The first and second gamma reference voltage regulators 20 and 30 decrease internal high-potential and internal low-potential gamma reference voltages INT_VH and INT_VL by the amplified voltage drop ΔV*W input from the voltage drop amplifier 10 and supply the decreased gamma reference voltages to the gamma compensated voltage generator 112.

The first gamma reference voltage regulator 20 receives the amplified voltage drop ΔV*W, the pixel driving voltage ELVDD, and the first reference voltage VCI* and generates an internal high-potential gamma reference voltage INT_VH, and decreases the internal high-potential gamma reference voltage INT_VH by the amplified voltage drop ΔV*W to generate a high-potential gamma reference voltage VH. The first gamma reference voltage regulator 20 generates the internal high-potential gamma reference voltage INT_VH by ELVDD+VCI*=INT_VH (e.g., see FIG. 10). The high-potential gamma reference voltage VH output from the first gamma reference voltage regulator 20 is supplied to the gamma compensated voltage generator 112.

The second gamma reference voltage regulator 30 receives the amplified voltage drop ΔV*W, the pixel driving voltage ELVDD, and the second reference voltage VCI' and generates an internal low-potential gamma reference voltage INT_VL, and decreases the internal low-potential gamma reference voltage INT_VL by the amplified voltage drop ΔV*W to generate a low-potential gamma reference voltage VL. The second gamma reference voltage regulator 30 generates the internal low-potential gamma reference voltage INT_VL by ELVDD−VCI'=INT_VL (e.g., see FIG. 10). The low-potential gamma reference voltage VL output from the second gamma reference voltage regulator 30 is supplied to the gamma compensated voltage generator 112.

The first and second reference voltages VCI* and VCI' define the voltage range of gamma compensated voltages output from the gamma compensated voltage generator 112 and the maximum and minimum gamma compensated voltages. Accordingly, the voltage range of data voltages Vdata output from the data driver 110 and the maximum and minimum data voltages are determined based on the first and second reference voltages VCI* and VCI'. The first and second reference voltages VCI* and VCI' range approximately between 1 V and 3 V. When VCI*=3 V and VCI'=1 V, the voltage range of gamma compensated voltages is maximized.

Figure 11:
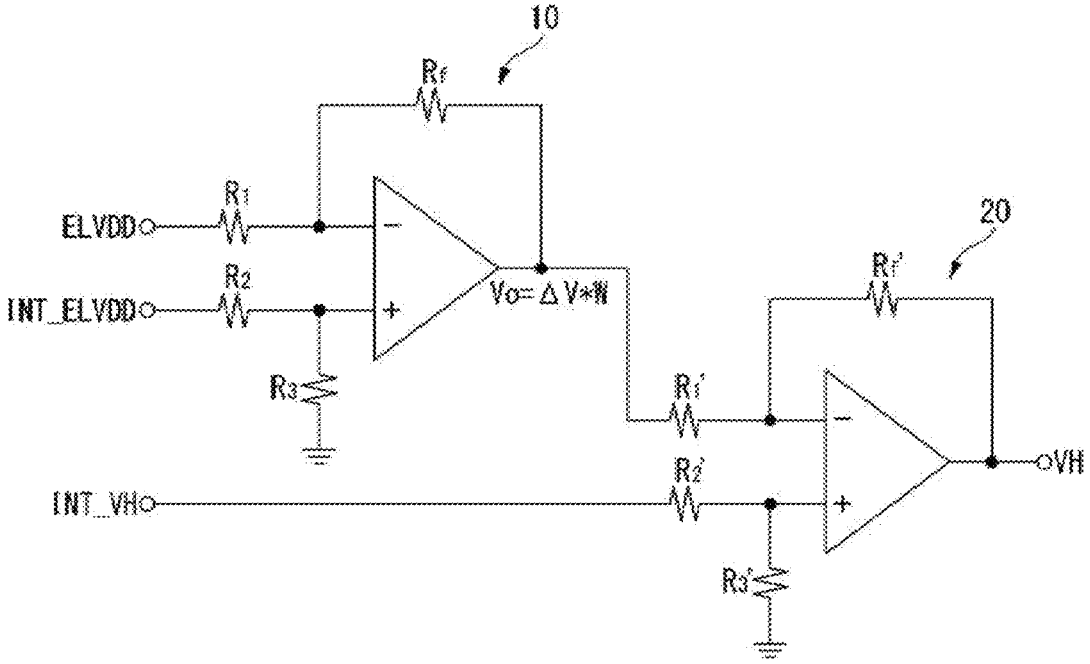
FIGS. 11 and 12 are circuit diagrams showing a luminance compensator according to embodiments of the present disclosure.
Figure 12:
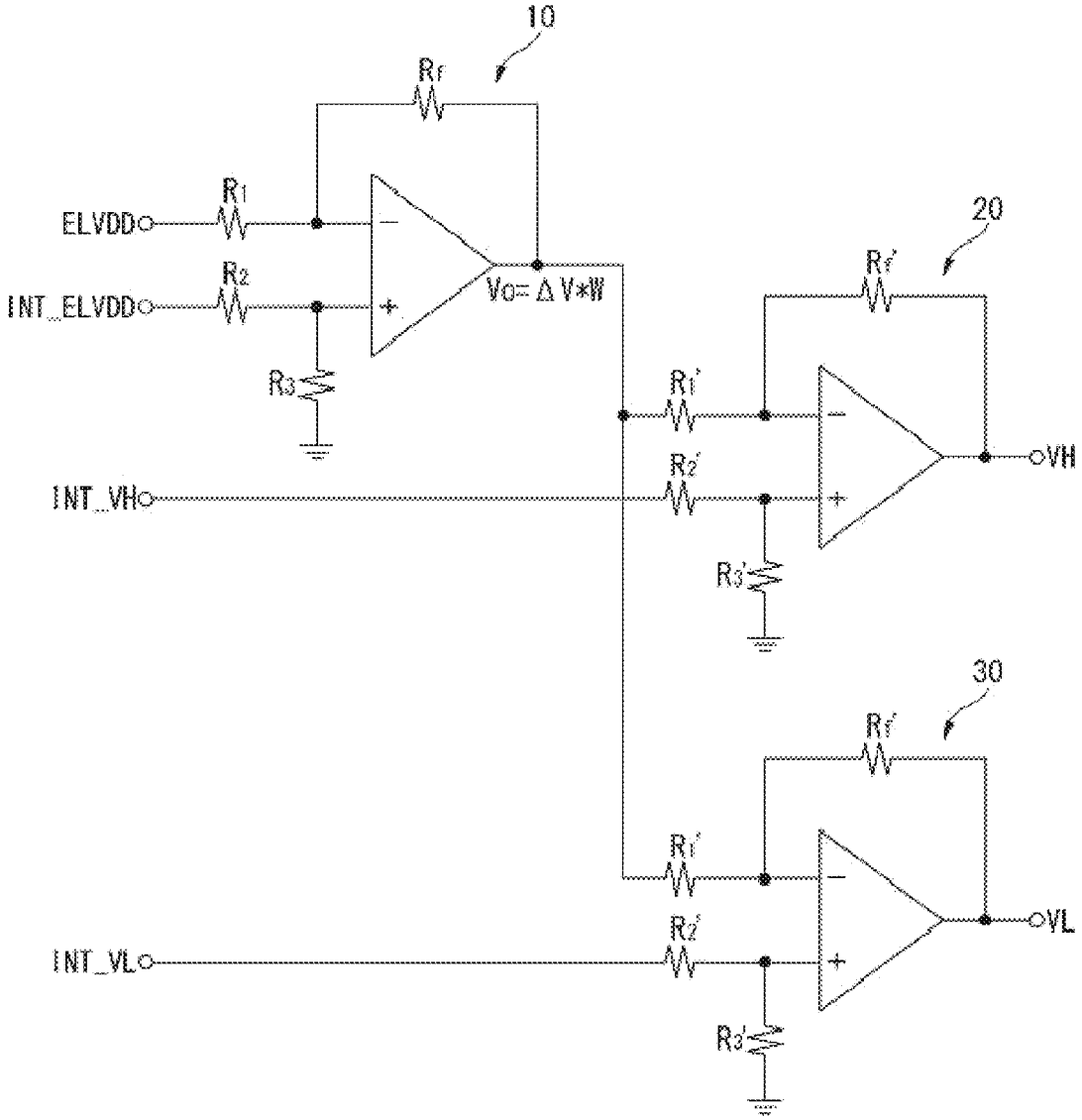

FIGS. 11 and 12 are circuit diagrams showing a luminance compensator.

Referring to FIGS. 11 and 12, the voltage drop amplifier 10 includes a first differential amplifier. The first differential amplifier includes an operational amplifier, a resistor R1 connected to an inverting input node (−) of the operational amplifier, to which an input voltage V1 is applied (ELVDD), a resistor R2 connected to a non-inverting input node (+) of the operational amplifier, to which a reference voltage V2 is applied (INT_ELVDD), and a resistor Rf connected between the inverting input node (−) and output node of the operational amplifier.

In FIG. 11, the output voltage (Vo=ΔV*W) of the differential amplifier is represented as follows:

$$Vo = \left[\frac{R_f}{R_1}\right]V1 + \left[1 + \frac{R_f}{R_1}\right]\left[\frac{R_3}{R_2 + R_3}\right]V2$$

wherein V1=ELVDD, and V2=INT_ELVDD.

If R1=R2 and Rf=R3, the output voltage Vo of the differential amplifier can be represented as follows:

$$Vo = \left[\frac{R_3}{R_1}\right](V1 - V2)$$

The amplification ratio is determined by the resistance ratio R3/R1. The weighted value W applied to the voltage drop LW in the pixel driving voltage ELVDD can be adjusted.

The first gamma reference voltage regulator 20 includes a second differential amplifier. The second gamma reference voltage regulator 30 includes a third differential amplifier. The second and third differential amplifiers each include an operational amplifier, a resistor R1' connected to an inverting input node (−) of the operational amplifier, to which an amplified voltage drop (Vo=ΔV*W) is applied, a resistor R2' connected to a non-inverting input node (+) of the operational amplifier, to which the internal high-potential gamma reference voltage INT_VH or the internal low-potential gamma reference voltage INT_VL is applied, and a resistor Rf connected between the inverting input node (−) and output node of the operational amplifier.

The output voltage VH of the second differential amplifier is represented as follows:

$$VH = \left[\frac{R'_f}{R'_1}\right]Vo + \left[1 + \frac{R'_f}{R'_1}\right]\left[\frac{R'_3}{R'_2 + R'_3}\right]\text{INT_VH}$$

If R1'=R2'=R3'=Rf', VH=INT_VH−Vo. Hence, the second differential amplifier operates as a subtractor.

The output voltage VL of the third differential amplifier is represented as follows:

$$VL = \left[\frac{R'_f}{R'_1}\right]Vo + \left[1 + \frac{R'_f}{R'_1}\right]\left[\frac{R'_3}{R'_2 + R'_3}\right]\text{INT_VL}$$

If R1'=R2'=R3'=Rf', VL=INT_VL−Vo. Hence, the third differential amplifier operates as a subtractor.

Table 1 shows the high-potential and low-potential gamma reference voltages VH and VL that are decreased by ΔV*W by the luminance compensator 114 when the pixel driving voltages of 4.6 V and 4.56 V are amplified by a weighted value W of 1.33 and a weighted value W of 2. The data voltages Vdata vary with the high-potential and low-potential gamma reference voltages VH and VL.

TABLE 1

| | | | | |
|---|---|---|---|---|
| ELVDD | 4.6 | 4.56 | 4.6 | 4.56 |
| VH | 2.2 | 2.1468 | 2.2 | 2.12 |
| VL | 6.3 | 6.2468 | 6.3 | 6.22 |
| Vdata | 3.1 | 3.0468 | 3.1 | 3.02 |

Figure 13:
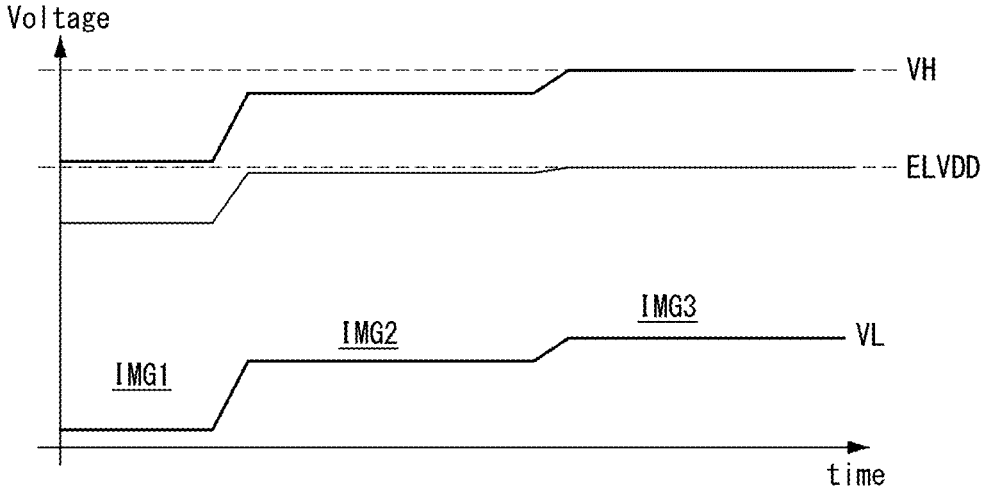
FIG. 13 is a view showing the amount of voltage drop in pixel driving voltage in image samples with different distributions of gray levels and the resulting gamma reference voltages according to an embodiment of the present disclosure.
Figure 14:
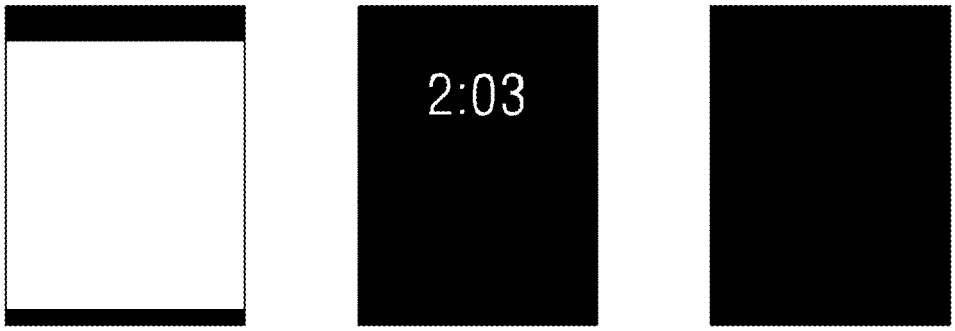
FIG. 14 is a view showing image samples with different proportions of ON pixels according to an embodiment of the present disclosure.

FIG. 13 is a view showing the amount of voltage drop in pixel driving voltage in image samples with different distributions of gray levels and the resulting gamma reference voltages. FIG. 14 is a view showing image samples with different proportions of ON pixels. In FIG. 14, "IMG1" is an image sample that has a high proportion of ON pixels since most of the pixels emit light, "IMG2" is an image sample that has a low proportion of ON pixels since most of the pixels on a standby screen are a black level except for a time indicator portion emitting light at a white level, and "IMG3" is an image sample that has no ON pixels since all pixels are turned off.

Referring to FIGS. 13 and 14, the luminance compensator 114 varies the high-potential and low-potential gamma reference voltages VH and VL by amplifying the voltage drop in the pixel driving voltage ELVDD which varies with load fluctuations on the display panel 100.

When the proportion of ON pixels is decreased, the high-potential and low-potential gamma reference voltages VH and VL rise by the amplified voltage drop ΔV*W in the pixel driving voltage ELVDD. This leads to a rise in data voltages Vdata, and, in turn, the gate voltage DTG of the driving element DT in the pixel circuit rises, thus decreasing luminance. Accordingly, the present disclosure can solve the problem of increased luminance resulting when the proportion of ON pixels is decreased.

In the image IMG1 with a high proportion of ON pixels, the voltage drop ΔV in the pixel driving voltage ELVDD input to the drive IC 300 is 0.1 V due to the amount of current flowing through the display panel 100. Since VH=ELVDD+VCI* and VL=ELVDD−VCI', the high-potential and low-potential gamma reference voltages VH and VL input to the gamma compensated voltage generator 112 are decreased by the decrease in the pixel driving voltage ELVDD. However, the voltage drop ΔV in the pixel driving voltage ELVDD input to the drive IC 300 is smaller than the voltage drop on the display panel 100. Accordingly, in embodiments of the present disclosure, the voltage drop ΔV in the pixel driving voltage ELVDD is amplified so that the voltage drop ΔV in the pixel driving voltage ELVDD input to the drive IC 300 is amplified by reflecting the voltage drop in the pixel driving voltage ELVDD which decreases on the pixels P on the display panel 100. In an example, the voltage drop can be amplified by two times. The voltage drop amplified by two times is 0.2 V.

In the image IMG2 with a low proportion of ON pixels, the voltage drop ΔV in the pixel driving voltage ELVDD is 0.02 V due to a decrease in the amount of current flowing through the display panel 100, and the voltage drop amplified by two times is 0.04 V. In this instance, the high-potential and low-potential gamma reference voltages VH and VL input to the gamma compensated voltage generator 112 rise, and, in turn, the data voltages Vdata output from the data driver 110 increase. The increase in the data voltages Vdata causes a rise in the gate voltage DTG of the driving element DT. Thus, the luminance of the image IMG2 with a low proportion of ON pixels is decreased, which prevents a luminance increase to the same level as the image IMG1 with a high proportion of ON pixels.

In the image IMG3 with no ON pixels, there is no voltage drop ΔV in the pixel driving voltage ELVDD since no current flows thorough the display panel 100. In this situation, ELVDD is 4.6 V, and the high-potential and low-potential gamma reference voltages VH and VL input to the gamma compensated voltage generator 112 are 4.6 V+VCI* and 4.6 V−VCI', respectively.

In embodiments of the present disclosure, the amount of increase in the luminance of pixels can be varied by properly adjusting the weighted value W for different image properties, such as movies and photographs, or for different modes of use, such as outdoor and normal environments. Moreover, the weighted value W can be set to 1 in a mode for better outdoor visibility to not amplify the voltage drop, or the weighted value W can be set to 1.2, 1.33, and so on, to increase the luminance of an image with a low APL. In a mode that desires luminance accuracy and chromatic coordinates as in photographs, a high weighted value like W=2 can be set.

A display device according to an embodiment of the present disclosure can be applied to mobile devices, video phones, smart watches, watch phones, wearable devices, foldable devices, rollable devices, bendable devices, flexible devices, curved devices, electronic organizers, electronic books, portable multimedia players (PMPs), personal digital assistants (PDAs), MP3 players, mobile medical devices, desktop PCs, laptop PCs, netbook computers, workstations, navigation equipment, automotive navigation equipment, automotive display devices, televisions (TVs), wallpaper devices, signage devices, gaming devices, notebook computers, monitors, cameras, camcorders, home appliances, etc. The display device according to an embodiment of the present disclosure can be applied to organic light-emitting lighting apparatuses or inorganic light-emitting lighting apparatuses.

As described above, in embodiments of the present disclosure, gamma reference voltages are adjusted by amplifying a voltage drop in pixel driving voltage, in order to reflect an actual voltage drop caused by load fluctuations on the display panel upon detecting a voltage drop in the pixel driving voltage in the display panel and host system. Therefore, the present disclosure can prevent the luminance of the screen from varying with the proportion of ON pixels.

The present disclosure can reduce power consumption by decreasing the rate at which luminance increases as the proportion of ON pixels decreases.

The present disclosure can achieve optimum picture quality in a usage environment and an operation mode, because the weighted value applied to a voltage drop can be varied depending on the usage environment and the operation mode.

The effects of the present disclosure are not limited what has been shown and described above, but more various effects are included in the present disclosure.

A luminance compensation device and an electroluminescent display using the same according to various embodiments of the disclosure can be described as follows.

The luminance compensation device includes a luminance compensator configured to compare a pixel driving voltage input from a host system and a reference pixel driving voltage generated within a drive IC to detect a voltage drop in the pixel driving voltage, and amplify the voltage drop by a predetermined weighted value to adjust a gamma reference voltage by the amplified voltage drop. The pixel driving voltage is supplied to a display panel.

The luminance compensator amplifies a difference between the pixel driving voltage and the reference pixel driving voltage.

The luminance compensation device further includes a gamma compensated voltage generator configured to receive a high-potential gamma reference voltage and a low-potential gamma reference voltage from the luminance compensator and divide the high-potential gamma reference voltage to output gamma compensated voltages between the high-potential gamma reference voltage and the low-potential gamma reference voltage. The luminance compensator decreases the high-potential gamma reference voltage and low-potential gamma reference voltage input to the gamma compensated voltage generator by the amplified voltage drop.

The luminance compensator includes a differential amplifier configured to amplify the difference between the pixel driving voltage and the reference pixel driving voltage; and a voltage drop amplifier configured to detect the voltage drop amplified using the differential amplifier.

The luminance compensator further includes a first gamma reference voltage regulator configured to receive the amplified voltage drop, the pixel driving voltage, and a predetermined first reference voltage to produce an internal high-potential gamma reference voltage, and decrease the internal high-potential gamma reference voltage by the amplified voltage drop to output the high-potential gamma reference voltage; and a second gamma reference voltage regulator configured to receive the amplified voltage drop, the pixel driving voltage, and a predetermined second reference voltage to produce an internal low-potential gamma reference voltage and decrease the internal low-potential gamma reference voltage by the amplified voltage drop to output the low-potential gamma reference voltage.

An electroluminescence display includes a display panel where a plurality of data lines, a plurality of gate lines, and a plurality of pixels to be supplied with a pixel driving voltage are arranged; a gamma compensated voltage generator configured to divide a gamma reference voltage to produce gamma compensated voltages; a data driver configured to convert a pixel data to the gamma compensated voltages to output data voltages and supply the data voltage to the data lines; and a luminance compensator configured to compare a pixel driving voltage input from a host system and a reference pixel driving voltage to detect a voltage drop in the pixel driving voltage, and amplify the voltage drop by a predetermined weighted value to adjust the gamma reference voltage by the amplified voltage drop.

The electroluminescence display further includes a drive IC including the gamma compensated voltage generator, the data driver, and the luminance compensator; and a circuit substrate that connects the host system and the display panel, where the drive IC is mounted. The luminance compensator amplifies a difference between the pixel driving voltage input to the drive IC and the reference pixel driving voltage to detect the amplified voltage drop.

The luminance compensator decreases a high-potential gamma reference voltage and low-potential gamma reference voltage input to the gamma compensated voltage generator by the amplified voltage drop.

The luminance compensator includes a differential amplifier configured to amplify the difference between the pixel driving voltage and the reference pixel driving voltage; and a voltage drop amplifier configured to detect the amplified voltage drop using the differential amplifier.

the luminance compensator further includes a first gamma reference voltage regulator configured to receive the amplified voltage drop, the pixel driving voltage, and a predetermined first reference voltage to produce an internal high-potential gamma reference voltage and decrease the internal high-potential gamma reference voltage by the amplified voltage drop to output the high-potential gamma reference voltage; and a second gamma reference voltage regulator configured to receive the amplified voltage drop, the pixel driving voltage, and a predetermined second reference voltage to produce an internal low-potential gamma reference voltage and decrease the internal low-potential gamma reference voltage by the amplified voltage drop to output the low-potential gamma reference voltage.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A luminance compensation device comprising:

a luminance compensator configured to:

receive a pixel driving voltage from a host system, the pixel driving voltage being supplied to both the luminance compensator and a display panel, receive a reference pixel driving voltage generated by a drive IC, compare the pixel driving voltage with the reference pixel driving voltage to detect a voltage drop in the pixel driving voltage, the voltage drop being a difference between the pixel driving voltage and the reference pixel driving voltage, amplify the voltage drop of the pixel driving voltage by a predetermined weighted value to generate an amplified voltage drop, and adjust a gamma reference voltage based on the amplified voltage drop to generate an adjusted gamma reference voltage, wherein the pixel driving voltage is adjusted in proportion to a number of pixels in an ON state in the display panel.

2. The luminance compensation device of claim 1, further comprising:

a gamma compensated voltage generator configured to:

receive a high-potential gamma reference voltage and a low-potential gamma reference voltage from the luminance compensator, and divide the high-potential gamma reference voltage to output gamma compensated voltages between the high-potential gamma reference voltage and the low-potential gamma reference voltage, wherein the luminance compensator decreases the high-potential gamma reference voltage and low-potential gamma reference voltage input to the gamma compensated voltage generator by the amplified voltage drop.

3. The luminance compensation device of claim 2, wherein the luminance compensator comprises:

a differential amplifier configured to amplify the difference between the pixel driving voltage and the reference pixel driving voltage to generate the amplified voltage drop; and a voltage drop amplifier configured to detect the amplified voltage drop using the differential amplifier.

4. The luminance compensation device of claim 3, wherein the luminance compensator further comprises:

a first gamma reference voltage regulator configured to:

receive the amplified voltage drop, the pixel driving voltage, and a predetermined first reference voltage, generate an internal high-potential gamma reference voltage based on the amplified voltage drop, the pixel driving voltage, and the predetermined first reference voltage, and decrease the internal high-potential gamma reference voltage by the amplified voltage drop to output the high-potential gamma reference voltage, the high-potential gamma reference voltage being based on the internal high-potential gamma reference voltage decreased by the amplified voltage drop; and a second gamma reference voltage regulator configured to:

receive the amplified voltage drop, the pixel driving voltage, and a predetermined second reference voltage, generate an internal low-potential gamma reference voltage based on the amplified voltage drop, the pixel driving voltage, and the predetermined second reference voltage, and decrease the internal low-potential gamma reference voltage by the amplified voltage drop to output the low-potential gamma reference voltage, the low-potential gamma reference voltage being based on the internal low-potential gamma reference voltage decreased by the amplified voltage drop.

5. The luminance compensation device of claim 4, wherein the high-potential gamma reference voltage and the low high-potential gamma reference voltage are lowered, in response to a change in the pixel driving voltage.

6. The luminance compensation device of claim 1, wherein the reference pixel driving voltage remains set at a constant voltage level, and wherein the pixel driving voltage varies based on a number of pixels in an ON state in the display panel.

7. An electroluminescence display comprising:

a display panel including a plurality of data lines, a plurality of gate lines, and a plurality of pixels to be supplied with a pixel driving voltage;

a gamma compensated voltage generator configured to divide a gamma reference voltage to produce gamma compensated voltages;

a data driver configured to convert pixel data to the gamma compensated voltages to output data voltages and supply the data voltages to the plurality of data lines; and a luminance compensator configured to:

compare the pixel driving voltage input from a host system with a reference pixel driving voltage to detect a voltage drop in the pixel driving voltage, and amplify the voltage drop by a predetermined weighted value to adjust the gamma reference voltage by the amplified voltage drop, wherein the pixel driving voltage is adjusted in proportion to a number of pixels in an ON state in the display panel.

8. The electroluminescence display of claim 7, further comprising:

a drive IC including the gamma compensated voltage generator, the data driver, and the luminance compensator; and a circuit substrate that connects the host system with the display panel, the drive IC being mounted on the circuit substrate, wherein the luminance compensator amplifies a difference between the pixel driving voltage input to the drive IC and the reference pixel driving voltage to detect the amplified voltage drop.

9. The electroluminescence display of claim 8, wherein the luminance compensator includes:

a differential amplifier configured to amplify the difference between the pixel driving voltage and the reference pixel driving voltage; and a voltage drop amplifier configured to detect the amplified voltage drop using the differential amplifier.

10. The electroluminescence display of claim 7, wherein the luminance compensator decreases a high-potential gamma reference voltage and a low-potential gamma reference voltage input to the gamma compensated voltage generator by the amplified voltage drop.

11. The electroluminescence display of claim 10, herein the luminance compensator further includes:

a first gamma reference voltage regulator configured to:

receive the amplified voltage drop, the pixel driving voltage, and a predetermined first reference voltage, generate an internal high-potential gamma reference voltage based on the amplified voltage drop, the pixel driving voltage, and the predetermined first reference voltage, and decrease the internal high-potential gamma reference voltage by the amplified voltage drop to output the high-potential gamma reference voltage, the high-potential gamma reference voltage being based on the internal high-potential gamma reference voltage decreased by the amplified voltage drop; and a second gamma reference voltage regulator configured to:

receive the amplified voltage drop, the pixel driving voltage, and a predetermined second reference voltage, generate an internal low-potential gamma reference voltage, and decrease the internal low-potential gamma reference voltage by the amplified voltage drop to output the low-potential gamma reference voltage, the low-potential gamma reference voltage being based on the internal low-potential gamma reference voltage decreased by the amplified voltage drop.

12. The electroluminescence display of claim 11, wherein the high-potential gamma reference voltage and the low high-potential gamma reference voltage are lowered, in response to a change in the pixel driving voltage.

13. The electroluminescence display of claim 7, wherein the reference pixel driving voltage remains set at a constant voltage level, and wherein the pixel driving voltage varies based on a number of pixels in an ON state in the display panel.

14. The electroluminescence display of claim 7, wherein the data voltages are increased in response to an increase in the amplified voltage drop.

15. A luminance compensation device for compensating pixels in a display panel, the luminance compensation device comprising:

a luminance compensator configured to:

receive a pixel driving voltage, receive a reference pixel driving voltage, detect a voltage drop in the pixel driving voltage based on the reference pixel driving voltage, adjust the pixel driving voltage in proportion to a number of pixels in an ON state in the display panel, and supply the adjusted pixel driving voltage to the display panel for driving the pixels.

16. The luminance compensation device of claim 15, wherein the luminance compensator is further configured to:

adjust the pixel driving voltage in proportion to a number of pixels in an ON state in the display panel to minimize luminance differences among the pixels in the display panel.

17. The luminance compensation device of claim 15, wherein the reference pixel driving voltage remains set at a constant voltage level while the pixel driving voltage varies based on a number of pixels in an ON state in the display panel.

18. The luminance compensation device of claim 15, further comprising:

a first gamma reference voltage regulator configured to:

receive the amplified voltage drop, the pixel driving voltage, and a predetermined first reference voltage, and output a high-potential gamma reference voltage based on the amplified voltage drop, the pixel driving voltage, and the predetermined first reference voltage; and a second gamma reference voltage regulator configured to:

receive an amplified voltage drop, the pixel driving voltage, and a predetermined second reference voltage, and output a high-potential gamma reference voltage based on the amplified voltage drop, the pixel driving voltage, and the predetermined second reference voltage.

* * * * *